US007159574B2

(12) United States Patent
Hayashi et al.

(10) Patent No.: US 7,159,574 B2
(45) Date of Patent: Jan. 9, 2007

(54) FUEL FEED APPARATUS HAVING OPENING IN SUB-TANK

(75) Inventors: Norihiro Hayashi, Kakamigahara (JP); Tetsuro Okazono, Okazaki (JP)

(73) Assignee: Denso Corporation, Kariya (JP)

( * ) Notice: Subject to any disclaimer, the term of this patent is extended or adjusted under 35 U.S.C. 154(b) by 164 days.

(21) Appl. No.: 11/041,984

(22) Filed: Jan. 26, 2005

(65) Prior Publication Data

US 2005/0166973 A1 Aug. 4, 2005

(30) Foreign Application Priority Data

Jan. 30, 2004 (JP) ..... 2004-23656

(51) Int. Cl.
*F02M 37/04* (2006.01)

(52) U.S. Cl. ..... 123/509; 137/574

(58) Field of Classification Search ..... 123/509, 123/514; 137/574

See application file for complete search history.

(56) References Cited

U.S. PATENT DOCUMENTS 4,672,937 A * 6/1987 Fales et al. ..... 123/509
5,263,458 A * 11/1993 Fujino et al. ..... 123/514
5,396,872 A * 3/1995 Ruger et al. ..... 123/514
5,456,235 A * 10/1995 Porter ..... 123/509
5,692,479 A * 12/1997 Ford et al. ..... 123/514
5,769,061 A 6/1998 Nagata et al. ..... 123/509
7,069,913 B1 * 7/2006 Crary ..... 123/509
2002/0124833 A1 * 9/2002 Fauser et al. ..... 123/509

* cited by examiner

*Primary Examiner*—Thomas Moulis
(74) *Attorney, Agent, or Firm*—Nixon & Vanderhye P.C.

(57) ABSTRACT

A fuel feed apparatus includes a sub-tank and a fuel pump that are received in the fuel tank. The sub-tank has an inner space that is partitioned into at least a first chamber and a second chamber. The fuel pump is arranged in the first chamber to discharge fuel received in the sub-tank to the outside of the fuel tank. The second chamber has an opening, through which the second chamber communicates with the outside of the sub-tank such that fuel accumulated in the second chamber is exhausted to the outside of the sub-tank through the opening. The fuel tank has a first tank space and a second tank space. The sub-tank is received in the first tank space. A first jet pump is disposed in the second chamber of the sub-tank. The first jet pump draws fuel accumulated in the second tank space into the first tank space.

5 Claims, 5 Drawing Sheets

FUEL FEED APPARATUS HAVING OPENING IN SUB-TANK

CROSS REFERENCE TO RELATED APPLICATIONS

This application is based on and incorporates herein by reference Japanese Patent Application No. 2004-23656 filed on Jan. 30, 2004.

FIELD OF THE INVENTION

The present invention relates to a fuel feed apparatus that feeds fuel received in a fuel tank to the outside of the fuel tank.

BACKGROUND OF THE INVENTION

A fuel feed apparatus disclosed in JP-A-9-268957 is capable of stably feeding fuel from an inside of a fuel tank to the outside, even when an amount of fuel received in the fuel tank decreases. The fuel feed apparatus includes a sub-tank that is received in the fuel tank. The inner space of the sub-tank needs to be partitioned into multiple chambers to individually receive components in the fuel feed apparatus having a specific structure. A fuel pump may be arranged in one of the separated chambers. In this structure, fuel can be circulated in the chamber receiving the fuel pump. However, fuel may remain in another chamber, in which the fuel pump is not provided, and the remaining fuel may be deteriorated due to oxidization. As a result, components of the fuel feed apparatus such as the sub-tank may be corroded due to the deteriorated fuel, and proper operation of components may not be maintained.

SUMMARY OF THE INVENTION

In view of the foregoing problems, it is an object of the present invention to produce a fuel feed apparatus that is capable of reducing fuel remaining in a sub-tank.

According to the present invention, a fuel feed apparatus, which is at least partially received in a fuel tank, includes a sub-tank and a fuel pump. The sub-tank is received in the fuel tank. The sub-tank has an inner space that is partitioned into at least a first chamber and a second chamber. The fuel pump is arranged in the first chamber. The fuel pump discharges fuel, which is received in the sub-tank, to the outside of the fuel tank. The second chamber defines an opening, through which the second chamber communicates with the outside of the sub-tank such that fuel accumulated in the second chamber is capable of being exhausted to the outside of the sub-tank through the opening.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
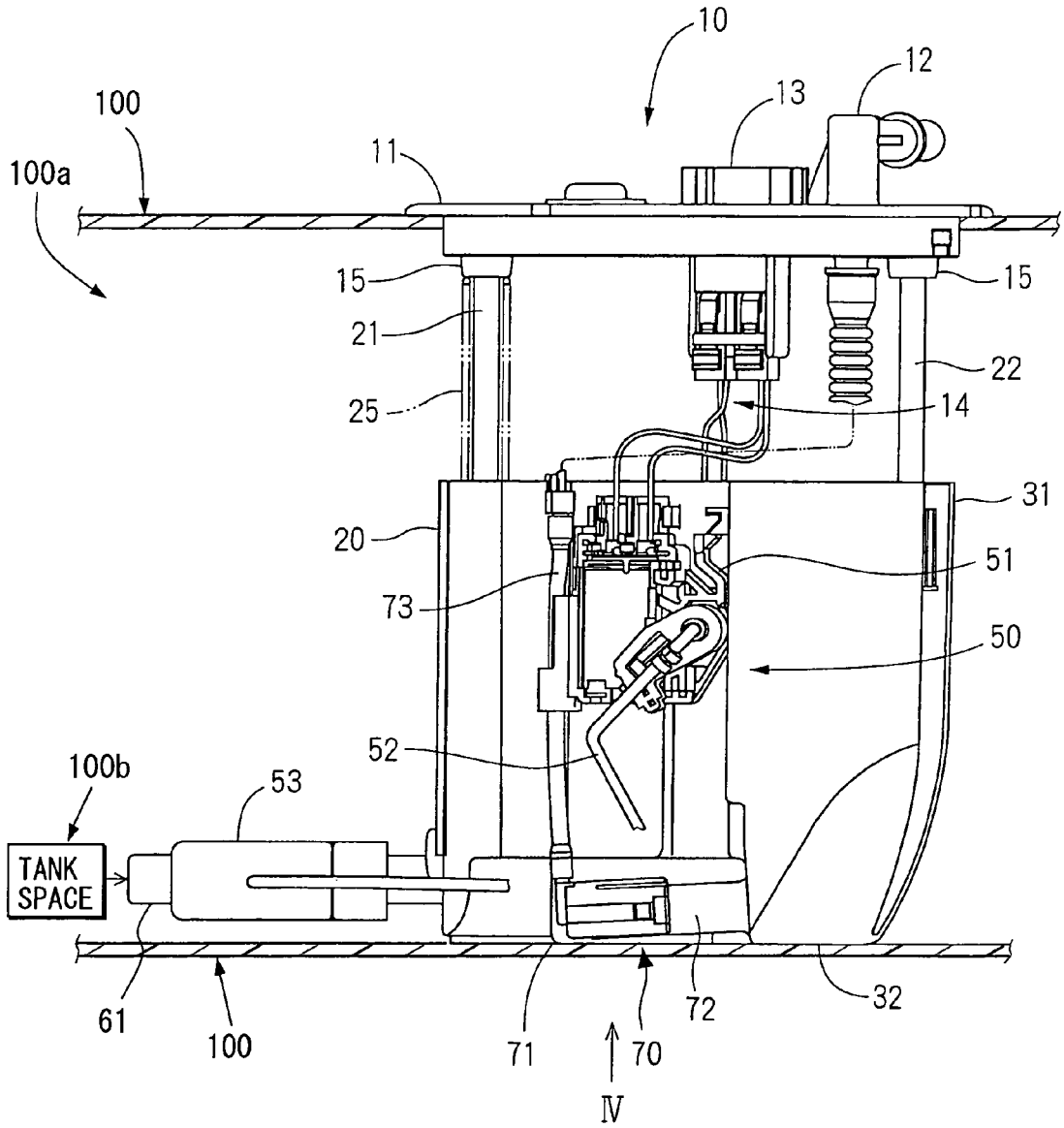
FIG. 1 is a side view showing a fuel feed apparatus according to a first embodiment of the present invention.
Figure 6:
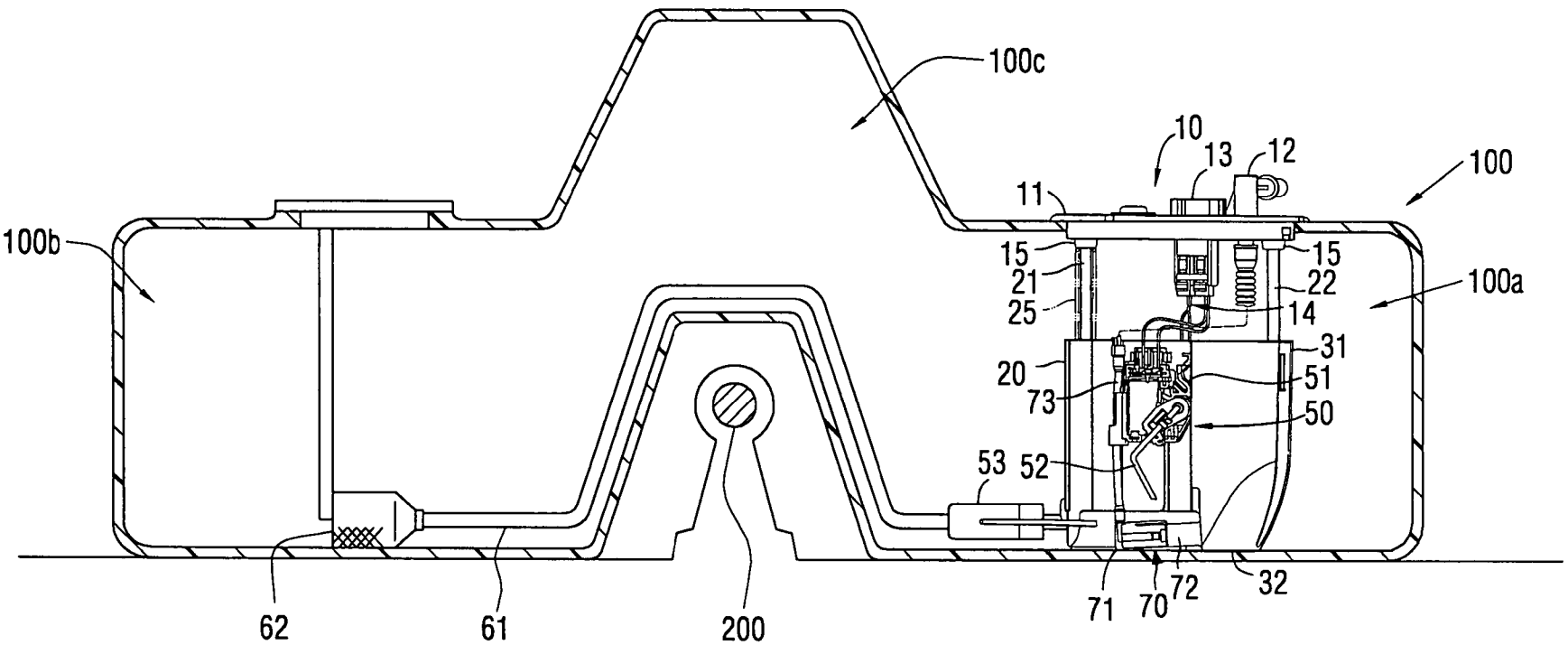
FIG. 6 is a cross-sectional side view showing a fuel tank receiving the fuel feed apparatus according to the first embodiment.

As shown in FIG. 1, a fuel feed apparatus 10 has a circular-shaped lid member 11 that covers an opening formed in an upper wall portion of a fuel tank 100. As shown in FIG. 6, the fuel tank 100, which receives the fuel feed apparatus 10, is integrally formed of resin to be in a saddleback shape, and is mounted in a vehicle over a drive shaft 200. The fuel tank 100 includes a first tank space **100*a* and a second tank space 100*b* that are communicated with each other through a connecting portion 100*c*, which is arranged to pass over the drive shaft 200. The fuel feed apparatus 10 is received in the first tank space 100*a* of the fuel tank 100**.

Figure 2:
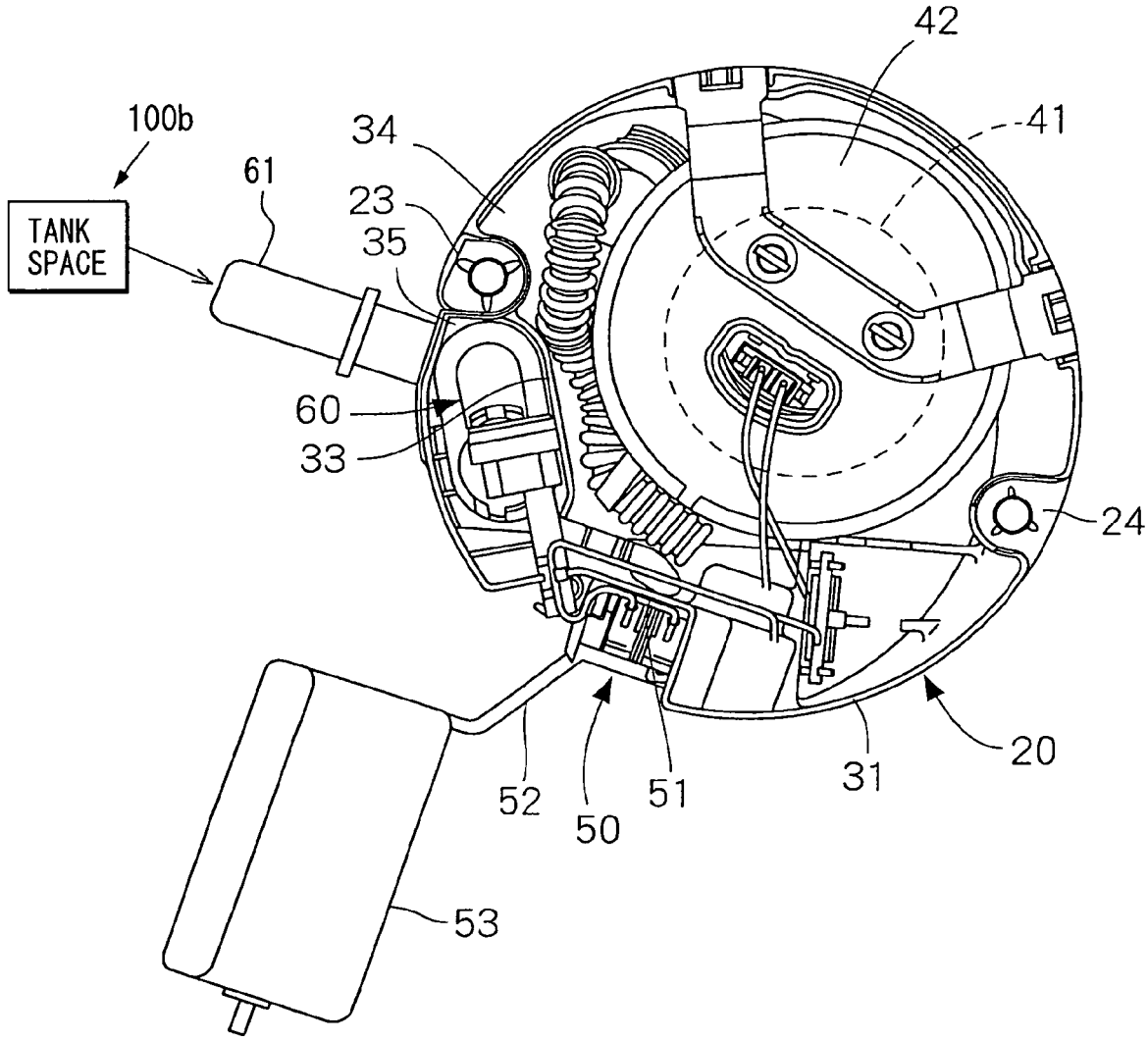
FIG. 2 is a top view showing the fuel feed apparatus according to the first embodiment.

As shown in FIGS. 1, 2, the fuel feed apparatus 10 includes the lid member 11 and a sub-tank 20. The fuel feed apparatus 10 further includes a first shaft 21 and a second shaft 22 that support the lid member 11 and the sub-tank 20 such that the lid member 11 and the sub-tank 20 are axially movable relative to each other. Most of the fuel feed apparatus 10 is received in the fuel tank 100 excluding the lid member 11.

The lid member 11 has a discharge pipe 12 and an electric connector 13. Fuel is discharged from a fuel pump 41 (FIG. 2) received in the sub-tank 20, and the fuel flows to the outside of the fuel tank 100 through the discharge pipe 12. The electric connector 13 is electrically connected with a power source (not shown) via a lead wire 14 to supply the fuel pump 41 received in the sub-tank 20 with electric power.

The first and second shafts 21, 22 (FIG. 1) are respectively press-inserted into press-insertion portions 15 provided to the lid member 11 on one axially end portions. The first and second shafts 21, 22 are respectively supported by a first supporting portion 23 and a second supporting portion 24 (FIGS. 2, 3), which are provided to the sub-tank 20, on the other axially end portions. The first and second shafts 21, 22 are made of a metallic material, such as stainless steel or aluminum, or a nonmetallic material such as resin. Referring back to FIG. 1, a spring 25 is provided to the outer circumferential periphery of the first shaft 21 as a biasing means. The spring 25 contacts with one of the press-insertion portions 15 of the lid member 11 on one axial end side of the spring 25. The spring 25 contacts with the sub-tank 20 on the other axial end side of the spring 25. The spring 25 axially resiliently extends such that the lid member 11 and the sub-tank 20 are axially apart from each other. Thus, the sub-tank 20 is pressed onto the inner bottom face of the fuel tank 100 by resilience of the spring 25, even when the fuel tank 100 expands or contracts due to a variation in pressure caused by a variation in temperature and a variation in amount of fuel.

As shown in FIG. 2, the sub-tank 20 receives the fuel pump 41, a fuel filter 42, a suction filter, a pressure regulator (none shown), a first jet pump 60 and a second jet pump 70 (FIG. 1). The suction filter filters relatively large debris contained in fuel that is drawn from the inside of the sub-tank 20 by the fuel pump 41. The pressure regulator controls pressure of fuel discharged from the fuel pump 41 at a predetermined pressure. The fuel filter (FIG. 2) filters relatively small debris contained in fuel discharged by the fuel pump 41. The fuel pump 41 is received in the sub-tank 20 such that the suction side of the fuel pump 41 is arranged on the lower side in FIG. 1, and the discharge side of the fuel pump 41 is arranged on the upper side in FIG. 1. The fuel pump 41 includes a motor (not shown) to generate suction force using a rotating member (not shown) that integrally rotates with the motor.

The sub-tank 20 is formed in a bottomed cylindrical shape that includes a circumferential wall portion 31, which is formed in a substantially cylindrical shape, and a bottom portion 32. The bottom portion 32 is arranged on the axially end side of the circumferential wall portion 31 on the axially opposite side as the lid member 11. The sub-tank 20 includes a partition wall 33 that partitions the inner space of the sub-tank 20 defined by the circumferential wall portion 31 and the bottom portion 32. The partition wall 33 forms a shortcut that substantially linearly connects two points of the inner circumferential periphery of the substantially cylindrical circumferential wall portion 31. That is, the partition wall 33 becomes a chord subtending an arc of the inner circumferential periphery of the circumferential wall portion 31. The partition wall 33 connects with the bottom portion 32 on the axially opposite end side as the lid member 11. Thus, the inner space of the sub-tank 20 is partitioned by the partition wall 33 into a main chamber (first chamber) 34 and a sub-chamber (second chamber) 35 as shown in FIG. 2. The main chamber 34 receives the fuel pump 41, the fuel filter 42, the suction filter, the pressure regulator, and the like. The sub-chamber 35 receives the first jet pump 60, and the like.

The first jet pump 60 jets fuel discharged from the fuel pump 41 to generate suction force for drawing fuel received in the second tank space 100*b* of the fuel tank 100 through a filter 62 and a passage pipe 61 (FIG. 6). Fuel is drawn from the second tank space 100*b* by the first jet pump 60, and the fuel is supplied into the sub-chamber 35 (FIG. 2), so that the fuel is accumulated in the sub-chamber 35. The height of the partition wall 33, which partitions the inner space of the sub-tank 20 into the main chamber 34 and the sub-chamber 35, is less than the height of the circumferential wall portion 31 in the vertical direction in FIG. 1. Specifically, the end portion of the partition wall 33 on the side of the lid member 11 is located on the side of the bottom portion 32, i.e., lower side compared with the end portion of the circumferential wall portion 31 on the side of the lid member 11. Fuel is drawn into the sub-chamber 35 by the first jet pump 60, and the fuel is accumulated in the sub-chamber 35. When liquid level of the fuel accumulated in the sub-chamber 35 exceeds the height of the partition wall 33, the fuel flows over the partition wall 33 into the main chamber 34. Thus, fuel overflows from the sub-chamber 35 into the main chamber 34 of the sub-tank 20 over the partition wall 33.

As shown in FIG. 1, the second jet pump 70 is provided to the outer circumferential periphery of the sub-tank 20. The second jet pump 70 includes a nozzle portion 71 and a throat portion 72. Fuel is pressurized in the fuel pump 41, and the pressurized fuel is partially supplied into the nozzle portion 71 through a fuel passage 73. The throat portion 72 communicates with the main chamber 34 (FIG. 2) of the sub-tank 20. Fuel is supplied from the fuel pump 41 into the nozzle portion 71, and the fuel is jetted from the nozzle portion 71 into the throat portion 72, so that suction pressure is generated in the throat portion 72, and fuel is drawn into the throat portion 72. Thus, fuel received in the outside of the sub-tank 20, i.e., fuel received in the first tank space 100*a* of the fuel tank 100 is drawn into the sub-tank 20 through the throat portion 72.

Fuel is constantly supplied into the main chamber 34 of the sub-tank 20, in which the fuel pump 41 is received, by the first and second jet pumps 60, 70. Therefore, fuel remaining around the sub-tank 20 can be drawn into the sub-tank 20, even when liquid level of fuel decreases in the first tank space 100*a* of the fuel tank 100. As a result, the inside of the sub-tank 20 can be filled with fuel, regardless of the liquid level in the fuel tank 100.

As shown in FIG. 2, the fuel feed apparatus 10 has a sender gauge 50, which serves as a level detecting means, provided to the outer periphery of the circumferential wall portion 31 of the sub-tank 20. The sender gauge 50 includes a detecting device 51, an arm 52 and a float 53. The detecting device 51 is provided to the circumferential wall portion 31 of the sub-tank 20. The arm 52 connects with the detecting device 51 on one end side, and connects with the float 53 on the other end side. The float 53 floats in fuel accumulated in the fuel tank 10. The float 53 vertically moves in the fuel accumulated in the fuel tank 100 in accordance with liquid level of fuel in the fuel tank 100. The arm 52, which connects with the float 53, is capable of rotating around the detecting device 51, such that the arm 52 rotates in accordance with vertical movement of the float 53. The arm 52 and the detecting device 51 are electrically connected with each other, and relative position between the arm 52 and the detecting device 51 can be detected as variation in resistance or the like. The arm 52 rotates in accordance with vertical movement of the float 53, so that liquid level of fuel can be measured by detecting variation in the relative position between the arm 52 and the detecting device 51. Liquid level of fuel is measured using the sender gauge 50, and the measured liquid level is transmitted as an electric signal to an external control device (not shown) via the electric connector 13.

Figure 3:
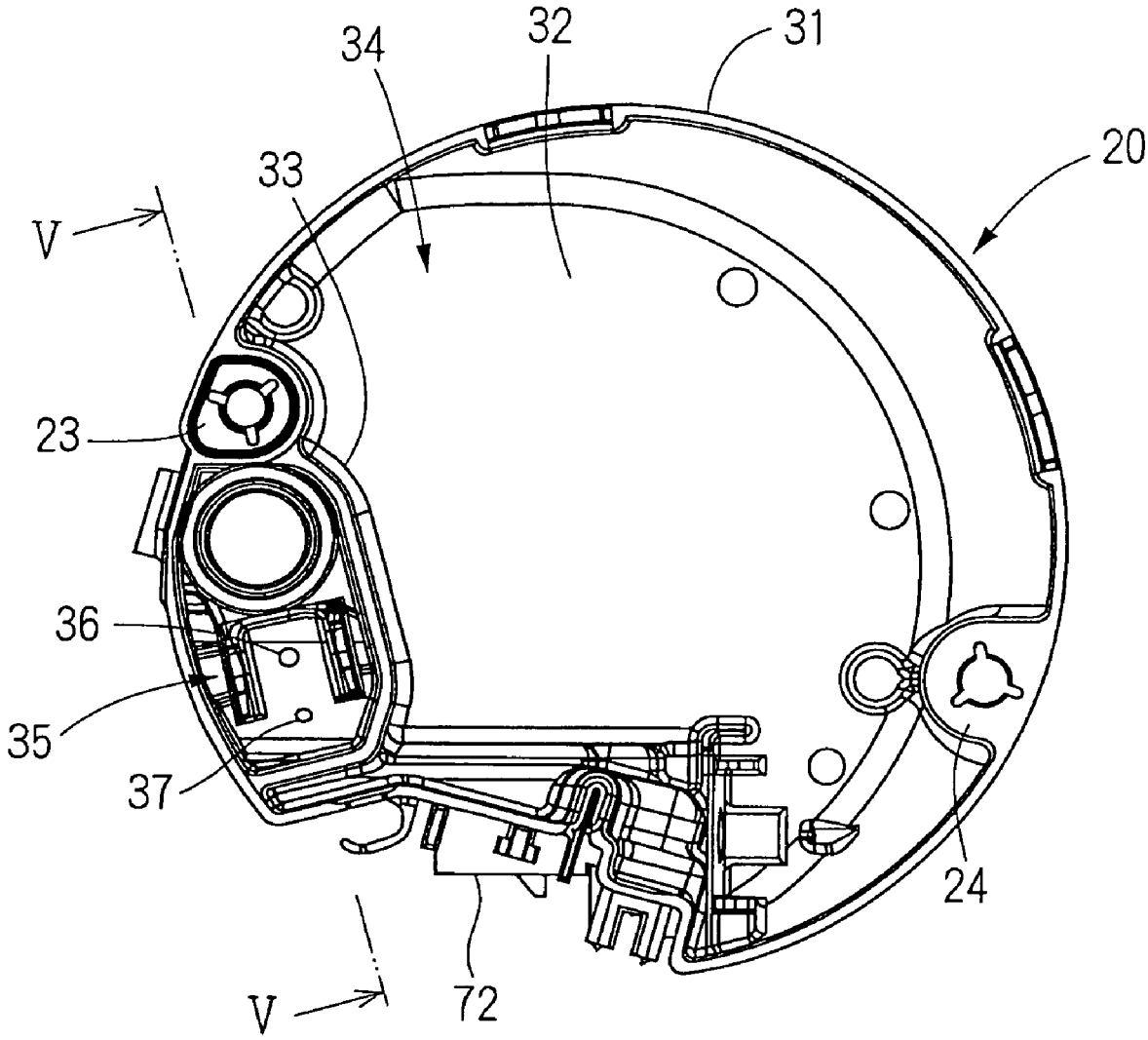
FIG. 3 is a top view showing a sub-tank of the fuel feed apparatus according to the first embodiment.
Figure 4:
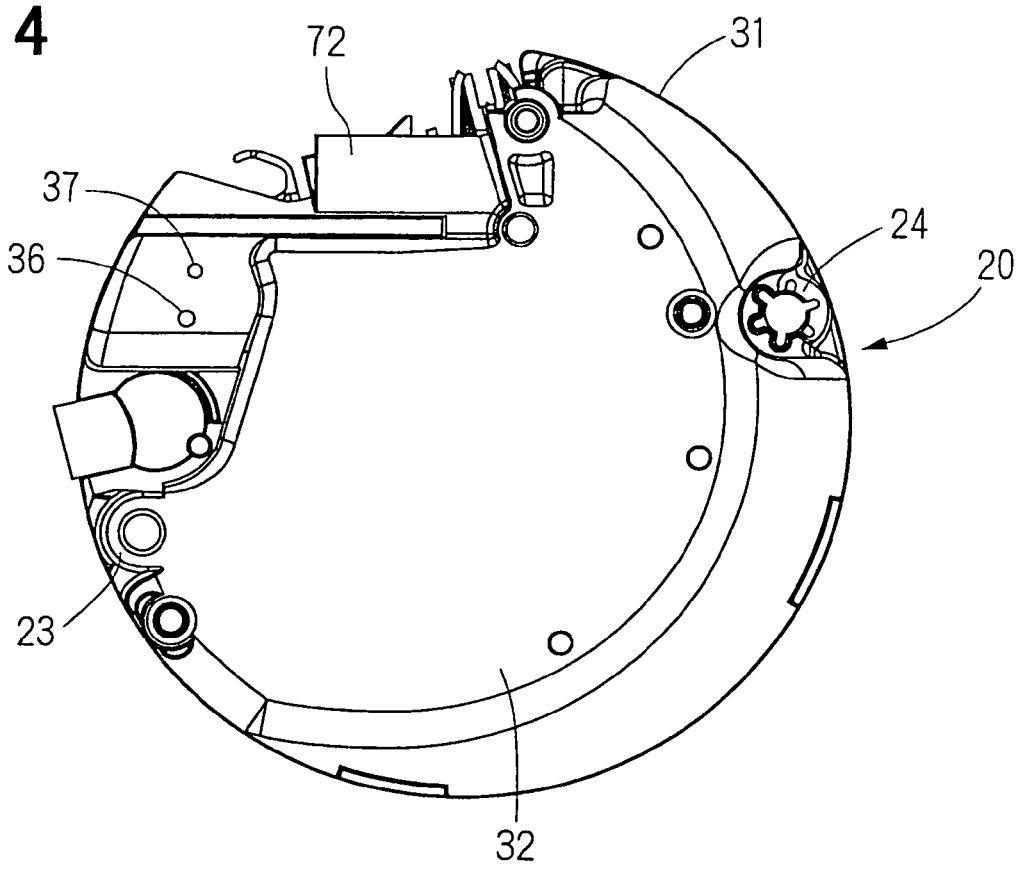
FIG. 4 is a bottom view showing the fuel feed apparatus when being viewed from the side of arrow IV in FIG. 1 according to the first embodiment.
Figure 5:
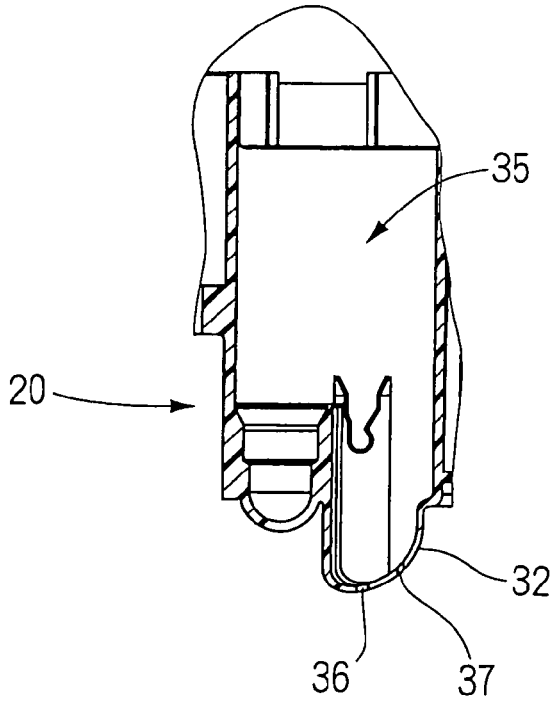
FIG. 5 is a cross-sectional side view taken along the line V—V in FIG. 3 according to the first embodiment.

As shown in FIGS. 3 to 5, the sub-tank 20 has openings 36, 37 in the sub-chamber 35 on the axially opposite side as the lid member 11, i.e., on the lower side of the sub-tank 20. The openings 36, 37 are through holes that respectively penetrate the bottom portion 32 of the sub-chamber 35 in a substantially axial direction of the sub-tank 20. Thus, the outside of the sub-chamber 35 and the inside of the sub-chamber 35 are communicated with each other through the openings 36, 37. Fuel received in the sub-chamber 35 is exhausted to the lower side in FIG. 1 through the openings 36, 37. Therefore, fuel can be exhausted from the sub-chamber 35 toward the inner bottom wall of the first tank space 100*a* of the fuel tank 100, which opposes to the bottom portion 32 of the sub-tank 20 in the axial direction of the sub-tank 20. Thus, fuel exhausted from the sub-chamber 35 through the openings 36, 37 can be restricted from interfering with the float 53 of the sender gauge 50 and the like.

Total opening area of both the openings 36, 37 is predetermined such that an amount of fuel exhausted from the sub-chamber 35 through the openings 36, 37 becomes less than an amount of fuel supplied from the second jet pump 70 into the sub-tank 20. Here, an amount of fuel supplied from the second jet pump 70 into the sub-tank 20 is defined to be Q1, and an amount of fuel exhausted from the sub-chamber 35 through the openings 36, 37 is defined to be Q2. Here, Q1 is greater than Q2 (Q1>Q2). That is, when the second jet pump 70 is operated, i.e., when the fuel feed apparatus 10 is operated, an amount of fuel supplied into the sub-chamber 35 becomes greater than an amount of fuel exhausted from the sub-chamber 35. Therefore, fuel can be constantly supplied into the sub-tank 20. On the contrary, when the fuel feed apparatus 10 is stopped, the first and second jet pumps 60, 70 are also stopped, so that fuel is not supplied into the sub-chamber 35. Therefore, fuel received in the sub-chamber 35 is drained through the openings 36, 37, and liquid level of fuel decreases in the sub-chamber 35. As a result, fuel received in the sub-chamber 35 can be substantially entirely drained when the fuel feed apparatus 10 is stopped.

The sub-chamber 35 of the sub-tank 20 has the openings 36, 37, so that fuel remaining in the sub-chamber 35 can be entirely drained to the outside of the sub-tank 20 through the openings 36, 37, when the fuel feed apparatus 10 is stopped. Therefore, an amount of fuel remaining in the sub-chamber 35 can be reduced, so that fuel can be restricted from deteriorating in the sub-chamber 35. A small amount of fuel may remain in the sub-chamber 35 while the fuel feed apparatus 10 is stopped. Even in this case, fuel received in the sub-chamber 35 can be circulated, when the fuel feed apparatus 10 is restarted, fuel is supplied into the sub-chamber 35, and fuel is exhausted through the openings 36, 37 again.

Thus, the first jet pump 60 received in the sub-chamber 35 can be protected from corroding and being damaged due to deteriorated fuel, so that operation of the first jet pump 60 can be maintained. Fuel received in the sub-chamber 35 can be drained through the openings 36, 37, so that fuel can be steadily removed from the sub-chamber 35.

The sub-tank 20 has the openings 36, 37 that substantially axially extend through the bottom portion 32 of the sub-chamber 35. Therefore, fuel exhausted from the sub-chamber 35 flows to the opposite side as the lid member 11 in the axial direction of the sub-tank 20, that is, fuel flow can be properly oriented by the openings 36, 37. Accordingly, fuel flowing from the sub-chamber 35 does not interfere with position of the float 53 of the sender gauge 50, even when the sender gauge 50 is provided to the outside of the sub-tank 20. Thus, liquid level of fuel can be precisely detected using the sender gauge 50.

Furthermore, total opening area of both the openings 36, 37 is predetermined such that the amount Q2 of fuel exhausted from the sub-chamber 35 through the openings 36, 37 becomes less than the amount Q1 of fuel supplied from the second jet pump 70 into the sub-tank 20. Therefore, fuel can be constantly supplied into the sub-tank 20 when the fuel feed apparatus 10 is operated, and fuel can be steadily drained from the sub-chamber 35 when the fuel feed apparatus 10 is stopped.

(Other Embodiment)

The above structure can be applied to a fuel feed apparatus, in which a first jet pump is not received in the sub-chamber 35, for example. Recently, commonality of components is enhanced to reduce manufacturing cost. Therefore, the above fuel feed apparatus 10 including the sub-tank 20 may be applied to a fuel tank that does not have the above saddleback shape including the first and second tank spaces 101*a*, 101*b*. In this structure, fuel need not to be communicated between the first and second tank spaces 101*a*, 101*b*, and the first jet pump need not to be provided to the fuel feed apparatus. Accordingly, the sub-chamber 35 may be a dead space, in which components are not received. Even in this case, the openings 36, 37 can be formed in the bottom side of the sub-chamber 35, so that fuel flowing into the sub-chamber 35 can be exhausted to the outside through the openings 36, 37. Therefore, fuel can be restricted from remaining in the sub-chamber 35, while components of the fuel feed apparatus 10 are standardized.

The sender gauge 50 may be arranged in another position, in which fuel exhausted from the openings 36, 37 does not affect the position of the sender gauge 50. Besides, the fuel feed apparatus may not have the sender gage 50. In these cases, the openings 36, 37 may be formed in the circumferential wall portion 31 of the sub-tank 20, instead of being formed in the bottom portion 32 of the sub-chamber 35.

An opening may be formed in the main chamber 34, so that fuel can be restricted from remaining in the main chamber 34.

The inside of the inner space of the sub-tank 20 may be partitioned into at least three spaces. In this case, an opening can be formed in at least one space of the at least three spaces.

The number of the openings is not limited to two, i.e., openings 36, 37. The number of the openings and the opening area of each opening may be freely determined in accordance with the shape of the sub-tank 20 and performance of the jet pump as appropriate.

The sub-chamber 35 may receive another component such as a thermistor used for a level sensor, in addition to the first jet pump, or instead of the first jet pump.

A jet pump may be additionally disposed in the sub-chamber to transfer fuel from the sub-chamber to the outside of the sub-chamber. In this case, the openings 36, 37 may be plugged.

Various modifications and alternations may be diversely made to the above embodiments without departing from the spirit of the present invention.

What is claimed is:

1. A fuel feed apparatus that is at least partially received in a fuel tank, the fuel feed apparatus comprising:

a sub-tank that is received in the fuel tank, the sub-tank has an inner space that is partitioned into at least a first chamber and a second chamber; and a fuel pump that is arranged in the first chamber, the fuel pump discharging fuel, which is received in the sub-tank, to an outside of the fuel tank, wherein the second chamber defines an opening through which the second chamber communicates with an outside of the sub-tank such that fuel accumulated in the second chamber is capable of being exhausted to the outside of the sub-tank through the opening.

2. The fuel feed apparatus according to claim 1, wherein the fuel tank includes a first tank space and a second tank space, and the sub-tank is received in the first tank space of the fuel tank, the fuel feed apparatus further comprising:

a first jet pump that is received in the second chamber of the sub-tank, wherein the first jet pump is capable of drawing fuel accumulated in the second tank space of the fuel tank into the first tank space of the fuel tank.

3. The fuel feed apparatus according to claim 1, the fuel feed apparatus further comprising:

a second jet pump that draws fuel received in the outside of the sub-tank into the sub-tank, wherein the opening has an opening area such that an amount of fuel, which is exhausted from the second chamber through the opening, is less than an amount of fuel, which is drawn from the second jet pump into the sub-tank.

4. The fuel feed apparatus according to claim 1, wherein the opening is defined in a bottom portion of the sub-tank.

5. The fuel feed apparatus according to claim 4, wherein the opening extends through the bottom portion of the sub-tank in a substantially axial direction of the sub-tank.

* * * * *